US009021785B2

(12) United States Patent
Moravec et al.

(10) Patent No.: US 9,021,785 B2
(45) Date of Patent: May 5, 2015

(54) ENGINE SYSTEM FOR INCREASING AVAILABLE TURBOCHARGER ENERGY

(71) Applicant: Electro-Motive Diesel, Inc., LaGrange, IL (US)

(72) Inventors: Keith E. Moravec, Downers Grove, IL (US); Teoman Uzkan, Indian Head Park, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 13/826,490

(22) Filed: Mar. 14, 2013

(65) Prior Publication Data

US 2014/0260193 A1 Sep. 18, 2014

Related U.S. Application Data

(60) Provisional application No. 61/849,829, filed on Jan. 31, 2013.

(51) Int. Cl.
*F02M 25/06* (2006.01)
*F01N 3/00* (2006.01)
(Continued)

(52) U.S. Cl.
CPC ..... *F01N 3/021* (2013.01); *F02M 25/0726* (2013.01); *F02M 25/0749* (2013.01); *F02M 25/074* (2013.01); *F02M 25/0715* (2013.01)

(58) Field of Classification Search
CPC ..... F02M 25/0715; F02M 15/0726; F02M 25/074; F02M 25/0749; F02D 21/08
USPC ..... 60/274, 276, 278, 287, 297, 299, 311, 60/324; 123/568.11, 568.12
See application file for complete search history.

(56) References Cited

U.S. PATENT DOCUMENTS 5,517,976 A 5/1996 Bächle et al.
5,671,600 A 9/1997 Pischinger et al.
(Continued)

FOREIGN PATENT DOCUMENTS

DE 197 17 846 11/1998
EP 1072765 6/2010
(Continued)

OTHER PUBLICATIONS

Dr. Johannes Kech et. al, "Exhaust Gas Recirculation: Internal Engine Technology for Reducing Nitrogen Oxide Emissions", Engine Technology, MTU Friedrichshafen GmbH, www.mtu-online.com (Aug. 2011).
(Continued)

*Primary Examiner* — Audrey K Bradley
(74) *Attorney, Agent, or Firm* — Finnegan, Henderson, Farabow, Garrett & Dunner, LLP

(57) ABSTRACT

An engine system for a machine is disclosed. The engine system may have an intake manifold configured to direct air into a donor cylinder and a non-donor cylinder of an engine. The engine system may also have a first exhaust manifold configured to direct exhaust from the non-donor cylinder to the atmosphere. The engine system may also have a second exhaust manifold configured to receive exhaust from the donor cylinder. The engine system may further have a control valve configured to selectively direct a first amount of exhaust from the second exhaust manifold to the intake manifold. In addition, the engine system may have an orifice configured to allow a second amount of exhaust to flow from the second exhaust manifold to the first exhaust manifold.

20 Claims, 5 Drawing Sheets

(51) Int. Cl.

| | |
|---|---|
| ***F01N 3/10*** | (2006.01) |
| ***F01N 3/02*** | (2006.01) |
| ***F01N 1/00*** | (2006.01) |
| ***F02B 47/08*** | (2006.01) |
| ***F02M 25/07*** | (2006.01) |
| ***F01N 3/021*** | (2006.01) |

(56) References Cited

U.S. PATENT DOCUMENTS

| | | | | |
|---|---|---|---|---|
| 6,082,100 | A | 7/2000 | Boegner et al. | |
| 6,945,235 | B1 | 9/2005 | Bertilsson et al. | |
| 7,941,999 | B2 | 5/2011 | Kasper et al. | |
| 8,316,829 | B2 * | 11/2012 | Piper et al. | 123/568.21 |
| 8,631,642 | B2 | 1/2014 | Carlill et al. | |
| 2004/0194463 | A1 | 10/2004 | Yanagisawa et al. | |
| 2006/0236680 | A1 | 10/2006 | Zhang et al. | |
| 2007/0039314 | A1 | 2/2007 | Mizuguchi | |
| 2007/0175457 | A1 * | 8/2007 | Lyons | 123/568.12 |
| 2008/0060624 | A1 | 3/2008 | Grandas | |
| 2011/0000190 | A1 | 1/2011 | Svensson et al. | |
| 2011/0146246 | A1 | 6/2011 | Farman et al. | |
| 2011/0253113 | A1 | 10/2011 | Roth et al. | |
| 2012/0078492 | A1 | 3/2012 | Freund et al. | |
| 2012/0323465 | A1 | 12/2012 | Peters et al. | |
| 2012/0323470 | A1 | 12/2012 | Klingbeil et al. | |
| 2013/0186376 | A1 * | 7/2013 | Peters et al. | 123/568.2 |
| 2013/0220288 | A1 | 8/2013 | Klingbeil | |
| 2013/0283766 | A1 * | 10/2013 | Primus et al. | 60/274 |

FOREIGN PATENT DOCUMENTS

| | | |
|---|---|---|
| GB | 2 093 909 | 9/1982 |
| JP | 2007/23920 | 7/2005 |
| WO | WO 2010/116064 | 10/2010 |
| WO | WO 2012/069376 | 5/2012 |

OTHER PUBLICATIONS

U.S. Patent Application of Keith A. Moravec et al., entitled "Engine System With Passive Regeneration of a Filter in EGR Loop" filed on Jan. 31, 2013.

U.S. Patent Application of Steven Dallas Johnson, entitled "Exhaust System Having Parallel EGR Coolers" filed on Jan. 31, 2013.

* cited by examiner

ENGINE SYSTEM FOR INCREASING AVAILABLE TURBOCHARGER ENERGY

RELATED APPLICATIONS

This application is entitled to and claims the benefit of priority from U.S. Provisional Application No. 61/849,829 by MORAVEC et al., filed Jan. 31, 2013, the contents of which are expressly incorporated herein by reference.

TECHNICAL FIELD

The present disclosure relates generally to an engine system and, more particularly, to an engine system for increasing available turbocharger energy.

BACKGROUND

Combustion engines such as diesel engines, gasoline engines, and gaseous-fuel-powered engines burn a mixture of air and fuel within the engine, generating mechanical power and a consequent flow of exhaust. Engine exhaust contains, among other things, unburnt fuel, particulate matter such as soot, and harmful gases such as nitrous oxide or carbon monoxide. Modern engines must meet stringent emissions standards, which permit engines to discharge only miniscule levels of nitrous oxide and soot into the atmosphere. To comply with these standards, an engine design must, therefore, balance the desire for increased power output with the need to reduce harmful emissions.

Modern engines often include a turbocharger, which helps to increase the power output by forcing more air into the combustion chambers of the engine than otherwise possible. The increased air intake permits the combustion of more fuel in the combustion chambers, increasing the power generated by the engine. To reduce harmful emissions, modern engines often use an exhaust gas recirculation (EGR) system, which recirculates a portion of the exhaust through the combustion chambers to reduce the amount of harmful emissions released into the atmosphere by the engine. Diverting some of the exhaust to the EGR system, however, decreases the amount of exhaust available to propel the turbocharger, which may decrease the power output from the engine.

One attempt to address the problems described above is disclosed in U.S. Pat. No. 5,517,976 of Bächle et al. that issued on May 21, 1996 ("the '976 patent"). The '976 patent discloses a diesel engine having two groups of cylinders. Exhaust from the first group of cylinders propels a turbocharger before being discharged to the atmosphere. An exhaust gas return device returns exhaust gas from the second group of cylinders to a fresh air supply for all engine cylinders or only the first group of cylinders. The '976 patent further discloses a connector conduit between the exhaust gas discharge from the first group of cylinders and the exhaust gas return from the second group of cylinders. The connector conduit includes a device for adjusting the cross-sectional flow area in the conduit to control the rate of return of exhaust gas in the exhaust gas return device. The system of the '976 patent also includes a soot filter located within the exhaust gas return device.

Although the system of the '976 patent may help to lower engine emissions, by recirculating the exhaust generated by the second group of cylinders through all cylinders of the engine, the system may still be less than optimal. Specifically, the system of the '976 patent controls the rate of exhaust gas flow in the exhaust gas return device using a single variable flow area device in the connector conduit. As a result, the system of the '976 patent may not be able to deliver sufficient exhaust to propel the turbocharger while simultaneously recirculating sufficient amount of exhaust through the engine to meet today's stringent emissions standards. Moreover, the soot filter in the exhaust gas return device of the '976 system may have to be periodically removed for cleaning, which may affect the availability of the engine and may increase the cost of operating the engine.

The engine system of the present disclosure solves one or more of the problems set forth above and/or other problems in the art.

SUMMARY

In one aspect, the present disclosure is directed to an engine system. The engine system may include an intake manifold configured to direct air into a donor cylinder and a non-donor cylinder of an engine. The engine system may also include a first exhaust manifold configured to direct exhaust from the non-donor cylinder to the atmosphere. The engine system may include a second exhaust manifold configured to receive exhaust from the donor cylinder. The engine system may further include a control valve configured to selectively direct a first amount of exhaust from the second exhaust manifold to the intake manifold. In addition, the engine system may include an orifice configured to allow a second amount of exhaust to flow from the second exhaust manifold to the first exhaust manifold.

In another aspect, the present disclosure is directed to a method of operating an engine. The method may include directing air through a first intake manifold into a donor cylinder and a non-donor cylinder of the engine. The method may also include directing exhaust from the non-donor cylinder through a first exhaust manifold to the atmosphere. The method may include directing exhaust from the donor cylinder to a second exhaust manifold. The method may further include selectively directing a first amount of exhaust from the second exhaust manifold to the first intake manifold. In addition, the method may include directing a second flow of exhaust from the second exhaust manifold through an orifice to the first exhaust manifold.

DETAILED DESCRIPTION

Figure 1:
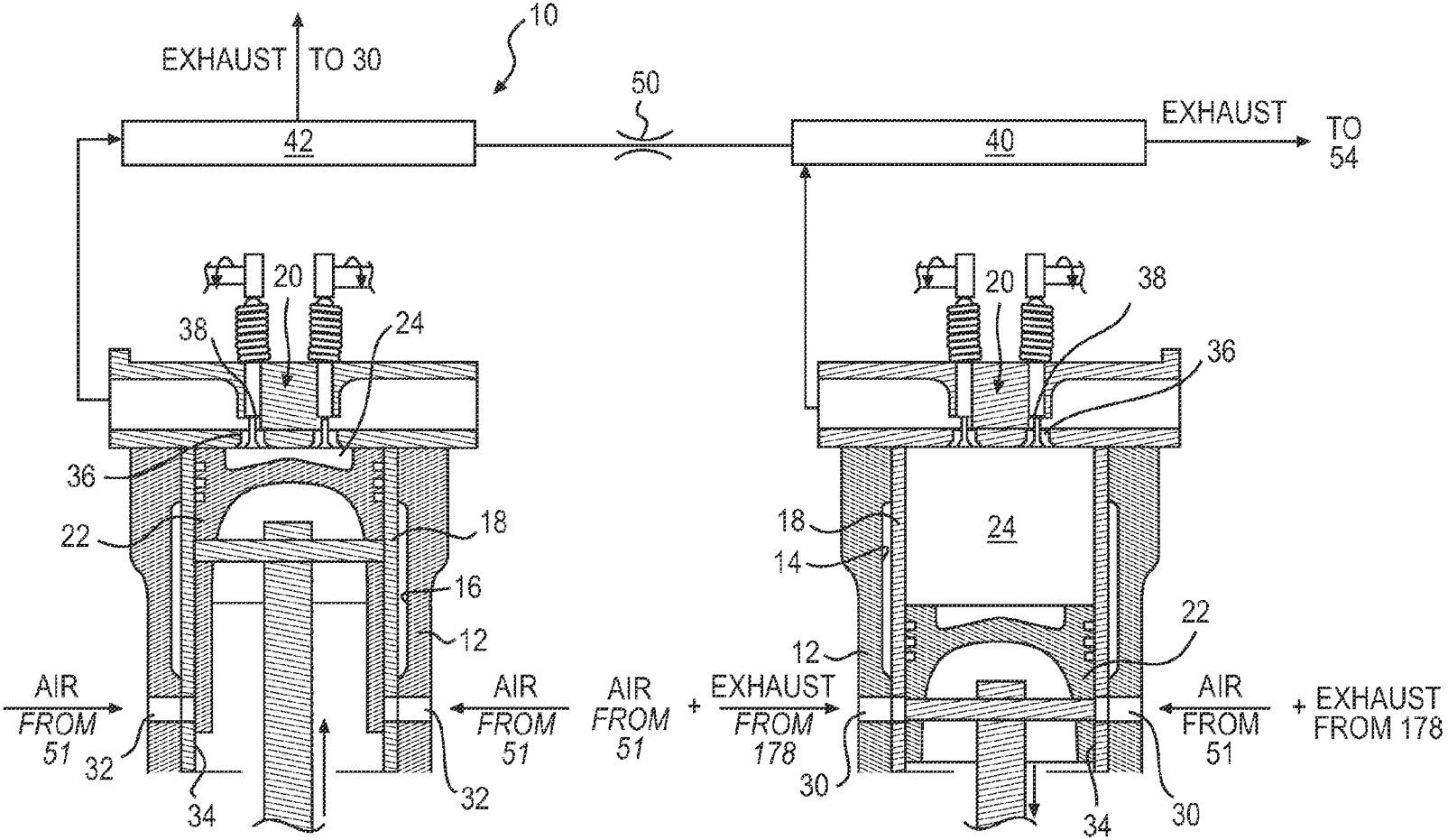
FIG. 1 is a cross-sectional illustration of an exemplary disclosed engine.

FIG. 1 illustrates a portion of an exemplary internal combustion engine 10. Engine 10 may be a two-stroke diesel engine. It is contemplated that engine 10 may be another type of engine, for example, a four-stroke diesel engine, a two-stroke or four-stroke gasoline engine, or a two-stroke or four-stroke gaseous-fuel-powered engine. Engine 10 may include, among other things, an engine block 12 that includes cylinders 14 and 16. Each of cylinders 14, 16 may include a cylinder liner 18 and a cylinder head 20 connected to engine block 12. A piston 22 may be slidably disposed within cylinder liner 18. Piston 22 together with cylinder liner 18 and cylinder head 20 may define a combustion chamber 24. Cylinders 14 may have the same or different dimensions and the same or different operating parameters compared to cylinders 16. It is contemplated that engine 10 may include any number of cylinders 14 and 16. Cylinders 14 and 16 may be disposed in an "in-line" configuration, in a "V" configuration, in an opposing-piston configuration, or in any other suitable configuration.

Piston 22 may be configured to reciprocate within cylinder liner 18 between a top-dead-center (TDC) and a bottom-dead-center (BDC). In particular, piston 22 may be pivotally connected to a crankshaft (not shown), which may be rotatably disposed within engine block 12 so that a sliding motion of each piston 22 within cylinder liner 18 results in a rotation of the crankshaft. Similarly, a rotation of the crankshaft may result in a sliding motion of piston 22. As the crankshaft rotates through about 180°, piston 22 may move through one full stroke between BDC and TDC. As the crankshaft rotates through about 360°, engine 10, as a two-stroke engine, may undergo a complete combustion cycle that includes a power/exhaust/intake stroke (TDC to BDC) and an intake/compression stroke (BDC to TDC).

In an exemplary two-stroke engine 10, during a final phase of the power/exhaust/intake stroke, air may be drawn and/or forced into combustion chamber 24 via one or more intake ports 30, 32 located within an annular surface 34 of cylinder liner 18. In particular, as piston 22 moves downward within cylinder liner 18, a position will eventually be reached at which intake ports 30, 32 are no longer blocked by piston 22 and instead are fluidly communicated with combustion chamber 24. When intake ports 30 are in fluid communication with combustion chamber 24 and a pressure of air at intake ports 30 is greater than a pressure within combustion chamber 24, air will pass from a passageway 51 or 178 through intake ports 30, 32, respectively, into combustion chamber 24. Fuel may be mixed with the air before, during, or after the air is drawn into combustion chamber 24.

During the beginning of the intake/compression stroke described above, air may still be entering combustion chamber 24 via intake ports 30 and piston 22 may be starting its upward stroke to mix any residual gas with air (and fuel, if present) in combustion chamber 24. Eventually, intake ports 30 may be blocked by piston 22 and further upward motion of piston 22 may compress the mixture. As the mixture within combustion chamber 24 is compressed, the pressure and temperature of the mixture will increase. The mixture may combust releasing chemical energy, which in turn may cause a significant increase in the pressure and temperature within combustion chamber 24.

After TDC, increased pressure within combustion chamber 24 may force piston 22 downward, thereby imparting mechanical power to the crankshaft. At a particular point during this downward travel, one or more exhaust valves 38 located within cylinder head 20 may open to allow pressurized exhaust within combustion chamber 24 to exit through exhaust manifolds 40 and 42. In particular, as piston 22 moves downward within cylinder liner 18, a position will eventually be reached at which exhaust valves 38 move to fluidly communicate combustion chamber 24 with exhaust ports 36. When combustion chamber 24 is in fluid communication with exhaust ports 36 and a pressure in combustion chamber 24 is greater than a pressure within exhaust ports 36, exhaust will pass from combustion chamber 24 through exhaust ports 36 into an exhaust manifold 40 or 42. In the disclosed embodiment, movement of exhaust valves 38 may be cyclically controlled by way of a cam (not shown) that is mechanically connected to the crankshaft. It is contemplated, however, that movement of exhaust valves 38 may be controlled in any other manner, as desired. It is also contemplated that exhaust ports 36 could alternatively be located within cylinder liner 18 with their opening and closing controlled by the piston motion and exhaust valves 38 omitted, if desired, such as in a loop-scavenged two-cycle engine. Although operation of a two-stroke engine 10 has been described with reference to FIG. 1, one skilled in the art would understand that fuel may be combusted and exhaust may be generated in a similar manner in a four-stroke engine 10.

As illustrated in FIG. 1, exhaust from cylinder 14 may pass into first exhaust manifold 40. Exhaust from cylinder 16 may similarly pass into second exhaust manifold 42. To reduce harmful emissions, a first amount of exhaust from second exhaust manifold 42 may be mixed with fresh air and reintroduced through intake ports 30 of cylinder 14 for combustion through a second cycle. A second amount of exhaust may also pass from second exhaust manifold 42 through orifice 50 into first exhaust manifold 40. Exhaust in first exhaust manifold 40, including exhaust received from second exhaust manifold 42 and from cylinder 14, may be discharged to the atmosphere. An engine cylinder 16, which donates an amount of exhaust for recirculation through another cylinder 14, will be referred to as a donor cylinder 16 in this disclosure. Cylinder 14 in contrast will be referred to as a non-donor cylinder 14 in this disclosure. Exhaust from a non-donor cylinder 14 may not be recirculated through either donor cylinders 16 or non-donor cylinders 14. As used in this specification, a non-donor cylinder 14 is one which may receive either just fresh air or a mixture of fresh air and exhaust from a donor cylinder 16. It is also contemplated that a donor cylinder 16 may receive either just fresh air or a mixture of fresh air and exhaust from a donor cylinder 16.

Figure 2:
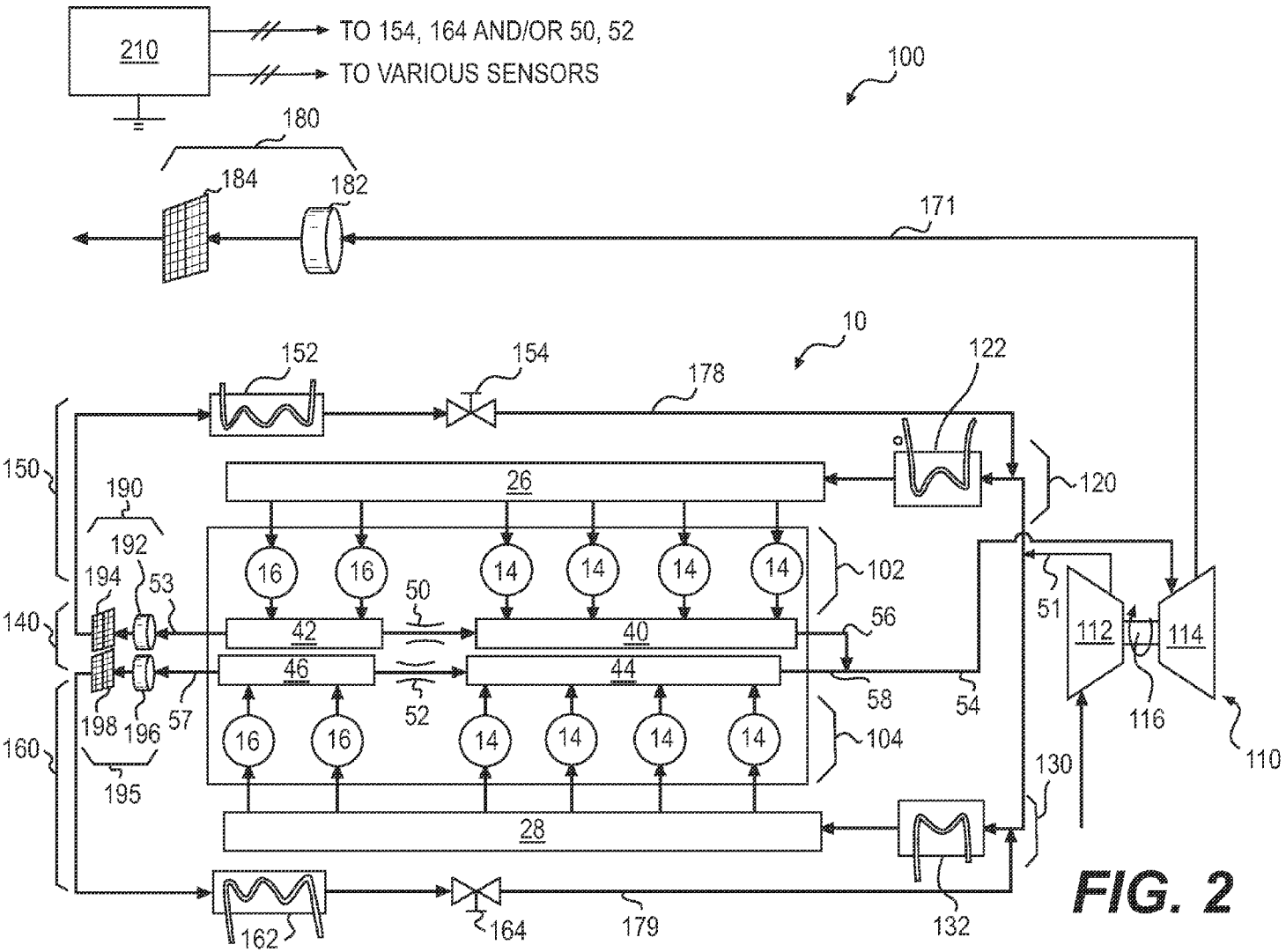
FIG. 2 is a diagrammatic illustration of an exemplary disclosed system that may be used in conjunction with the engine of FIG. 1.

FIG. 2 illustrates an engine system 100, which may be used in conjunction with engine 10. As shown in FIG. 2, engine 10 may include a first cylinder bank 102 and a second cylinder bank 104. It is contemplated, however, that engine 10 may include any number of cylinder banks 102, 104. Each of first and second cylinder banks 102, 104 may include one or more non-donor cylinders 14 and one or more donor cylinders 16. It is also contemplated that a cylinder bank like first cylinder bank 102 in engine 10 may contain only non-donor cylinders 14, only donor cylinders 16, or a combination of both non-donor cylinders 14 and donor cylinders 16. It is further contemplated that a cylinder bank like second cylinder bank 104 in engine 10 may similarly contain only non-donor cylinders 14, only donor cylinders 16, or a combination of both non-donor cylinders 14 and donor cylinders 16. Engine system 100 may include components configured to introduce air into non-donor cylinders 14 and donor cylinders 16, and discharge exhaust generated in the non-donor cylinders 14 and donor cylinders 16 to the atmosphere. For example, engine system 100 may include turbocharger 110, first intake arrangement 120, second intake arrangement 130, exhaust arrangement 140, first EGR circuit 150, second EGR circuit 160, and controller 210. One skilled in the art would understand that for clarity FIG. 2 illustrates only some of the components of engine system 100 and that engine system 100 may include many other components such as blowers (not shown).

Turbocharger 110 may include compressor 112, which may compress air and direct the compressed air via passageway 51 to first intake manifold 26 and second intake manifold 28 through first aftercooler 122 and second aftercooler 132, respectively. Compressor 112 may be driven by turbine 114, which may be propelled by exhaust flowing out from exhaust arrangement 140 in passageway 54. Exhaust may exit turbine 114 and be discharged to the atmosphere via passageway 171. Compressor 112 may embody a fixed geometry compressor, a variable geometry compressor, or any other type of compressor configured to draw air from the atmosphere and compress the air to a predetermined pressure level before compressed air enters engine 10. Turbine 114 may be directly and mechanically connected to compressor 112 by way of a shaft 116 to form turbocharger 110. As hot exhaust gases exiting exhaust arrangement 140 via passageway 54 move through and expand in turbine 114, turbine 114 may rotate and drive compressor 112 to pressurize inlet air. Although only one turbocharger 110 is depicted in FIG. 2, it is contemplated that engine system 100 may include any number of turbochargers 110. Moreover, each turbocharger 110 may include any number of compressors 112 and turbines 114.

First intake arrangement 120 may include first intake manifold 26 and first aftercooler 122. First aftercooler 122 may receive compressed air from compressor 112. First aftercooler 122 may cool the compressed air and direct the cool compressed air to first intake manifold 26, which in turn may direct the air to non-donor cylinders 14 and donor cylinders 16. Similarly, second intake arrangement may include second intake manifold 28 and second aftercooler 132. Second intake arrangement 130 may function in a manner similar to that of first intake arrangement 120. Although FIG. 2 depicts two intake arrangements 120, 130, it is contemplated that air may be introduced into non-donor cylinders 14 and donor cylinders 16 via any number of intake arrangements 120, 130.

Exhaust arrangement 140 may include first exhaust manifold 40, second exhaust manifold 42, third exhaust manifold 44, fourth exhaust manifold 46, first orifice 50, and second orifice 52. First exhaust manifold 40 may receive exhaust generated by first non-donor cylinder 14 in first cylinder bank 102. Second exhaust manifold 42 may receive exhaust generated by first donor cylinder 16 in first cylinder bank 102. Third exhaust manifold 44 may receive exhaust generated by second non-donor cylinder 14 in second cylinder bank 104. Fourth exhaust manifold 46 may receive exhaust generated by second donor cylinder 16 in second cylinder bank 104. First orifice 50 may restrict flow of exhaust between second exhaust manifold 42 and first exhaust manifold 40. Similarly, second orifice 52 may restrict flow of exhaust between fourth exhaust manifold 46 and third exhaust manifold 44. The flow restriction resulting from first and second orifices 50, 52 may generate a manifold pressure (commonly referred to as back pressure) within second exhaust manifold 42 and fourth exhaust manifold 46, thereby diverting a desired amount of exhaust away from first and second orifices 50 and 52, respectively, and into first and second EGR circuits 150 and 160, respectively. Despite the back pressure, some exhaust may travel from second exhaust manifold 42 through first orifice 50 into first exhaust manifold 40. Similarly, some exhaust may travel from fourth exhaust manifold 46 through second orifice 52 into third exhaust manifold 44. It is contemplated that, in some exemplary embodiments, first and second orifices 50, 52 may be comprise control valves or other variable cross-sectional flow area devices known in the art to allow variable amounts of exhaust to flow from the second and fourth exhaust manifolds 42, 46 to first and third exhaust manifolds 40, 44, respectively.

Although two separate exhaust manifolds (e.g. 40, 44) associated with non-donor cylinders 14 have been described above, it is contemplated that first and third exhaust manifolds 40, 44 may be replaced by a single exhaust manifold which receives exhaust from all non-donor cylinders 14. Similarly, it is contemplated that second and fourth exhaust manifolds 42, 46 may be replaced by a single exhaust manifold associated with all donor cylinders 16. It is also contemplated that in some exemplary embodiments, there may be more than two exhaust manifolds associated with non-donor cylinders 14 and with donor cylinders 16. Further, the exhaust manifolds associated with donor cylinders 16 may be connected with exhaust manifolds associated with non-donor cylinders 14 by one or more orifices 50, 52.

First EGR circuit 150 may include first EGR cooler 152 and first control valve 154. First control valve 154 may regulate a flow of exhaust in passageway 178 of first EGR circuit 150. For example, first control valve 154 may selectively direct a first amount of exhaust from second exhaust manifold 42 to flow through first EGR circuit 150 to first intake manifold 26. First EGR cooler 152 may cool the first amount of exhaust, which may mix with fresh air supplied by compressor 112. The mixture of air and the first amount of exhaust may be further cooled by first aftercooler 122. The cooled mixture may enter first intake manifold 26, which may direct the mixture into non-donor cylinders 14 and donor cylinders 16. A second amount of exhaust may pass from second exhaust manifold 42 through first orifice 50 to first exhaust manifold 40.

Second EGR circuit 160 may include second EGR cooler 162 and second control valve 164. Second control valve 164 may regulate the flow of exhaust in passageway 179 of second EGR circuit 160. For example, second control valve 164 may selectively direct a third amount of exhaust from fourth exhaust manifold 46 to flow through second EGR circuit 160 to second intake manifold 28. Like first EGR cooler 152, second EGR cooler 162 may cool the third amount of exhaust, which may mix with fresh air supplied by compressor 112. The mixture of air and the third amount of exhaust may be further cooled by second aftercooler 132. The cooled mixture may enter second intake manifold 28, which may direct the mixture to non-donor cylinders 14 and donor cylinders 16. A fourth amount of exhaust may pass from fourth exhaust manifold 46 through second orifice 52 to third exhaust manifold 44. Although FIG. 2 depicts first and second control valves 154, 164 located after first and second EGR coolers 152, 162, respectively, it is contemplated that first and second control valves 154, 164 may be located anywhere in first and second EGR circuits 150, 160, respectively. It is also contemplated that first and second EGR circuits 150, 160 may include any number of first and second control valves 154, 164, respectively.

First and second EGR coolers 152, 162 may be configured to cool exhaust flowing through first and second EGR circuits 150, 160, respectively. First and second EGR coolers 152, 162 may include an air-to-liquid heat exchanger, an air-to-air heat exchanger, or any other type of heat exchanger known in the art for cooling an exhaust flow. Similarly, first and second aftercoolers 122, 132 may include an air-to-liquid heat exchanger, an air-to-air heat exchanger, or any other type of heat exchanger known in the art for cooling an exhaust flow or compressor discharge.

First control valve 154 may be a two position or proportional type valve having a valve element movable to regulate a flow of exhaust through passageway 178. The valve element in first control valve 154 may be hydraulic or pneumatic and may be solenoid-operable to move between a flow-passing position and a flow-blocking position. It is also contemplated that the valve element in first control valve 154 may be operable in any other manner known in the art. In the flow-passing position, first control valve 154 may permit exhaust to flow through passageway 178 substantially unrestricted by first control valve 154. In contrast, in the flow-blocking position, first control valve 154 may completely block exhaust from flowing through passageway 178. Second control valve 164 may regulate a flow of exhaust through passageway 179 and may have a structure and method of operation similar to that of first control valve 154.

Exhaust from first and third exhaust manifolds 40, 44 may merge into passageway 54, which may direct the exhaust to turbine 114. Passageway 171 may direct exhaust from turbine 114 to the atmosphere. After-treatment component 180 may be disposed in passageway 171 to treat the exhaust before discharging the exhaust into the atmosphere. After-treatment component 180 may include a diesel oxidation catalyst (DOC) 182 and a diesel particulate filter (DPF) 184. DOC 182 may be located upstream from DPF 184. DPF 184 may trap soot in the exhaust flowing in passageway 171. When DOC 182 reaches an activation temperature, nitrous oxide flowing through passageway 171 may interact with the soot trapped in DPF 184 to oxidize some or all of the soot. One skilled in the art would recognize that exhaust from first and third exhaust manifolds 40, 44 may be supplied to one or more turbines 114 via one or more passageways 56, 58. One skilled in the art would also recognize that more than one DOC 182 and DPF 184 may be employed by engine system 100 to treat the exhaust in passageway 171. Further, one skilled in the art would recognize that any other types of after-treatment devices known in the art may be employed by engine system 100 in addition to or as an alternative to after-treatment component 180.

DOC 182, may include a flow-through substrate having, for example, a honeycomb structure or any other equivalent structure with many parallel channels for exhaust to flow through. The honeycomb or other structure of the substrate in DOC 182 may increase the contact area of the substrate to exhaust, allowing more of the undesirable constituents to be oxidized as exhaust passes through DOC 182. A catalytic coating (for example, of a platinum group metal) may be applied to the surface of the substrate to promote oxidation of some constituents (such as, for example, hydrocarbons, carbon monoxide, oxides of nitrogen, etc.) of exhaust as it flows through DOC 182.

DPF 184 may be a device used to physically separate soot or particulate matter from an exhaust flow. DPF 184 may include a wall-flow substrate. Exhaust may pass through walls of DPF 184, leaving larger particulate matter accumulated on the walls. It is contemplated that DPF 184 may be a filter, wire mesh screen, or may have any other suitable configuration known in the art for trapping soot particles. As is known in the art, DPF 184 may be regenerated periodically to clear the accumulated particulate matter. Additionally or alternatively, DPF 184 may be removed from engine system 100 and cleaned or replaced during routine maintenance.

First after-treatment component 190 may be disposed in passageway 53 to treat exhaust flowing from second exhaust manifold 42 into first EGR circuit 150. First after-treatment component 190 may include a DOC 192 and a DPF 194. DOC 192 may be located upstream from DPF 194. Like first after-treatment component 190, a second after-treatment component 195 may be disposed in passageway 57 to treat exhaust flowing from fourth exhaust manifold 46 into second EGR circuit 160. Second after-treatment component 195 may include a DOC 196 and a DPF 198. DOC 196 may be located upstream from DPF 198. DOCs 192. 196 may function in a manner similar to DOC 182. Similarly DPFs 194, 198 may function in a manner similar to DPF 184. One skilled in the art would recognize that one or more first and second after-treatment components 190, 195 may be disposed in one or more of passageways 53, 57. Further, one skilled in the art would recognize that any other types of after-treatment devices known in the art may be employed by engine system 100 in addition to or as an alternative to first after-treatment component 190.

Controller 210 may be configured to control the operation of engine system 100. Before, during, and/or after regulating exhaust flow through first and second EGR circuits 150, 160 via first and second control valves 154, 164, respectively, controller 210 may receive data indicative of an operational condition of engine 10 and/or an actual flow rate, temperature, pressure, and/or constituency of exhaust within first, second, third, and fourth exhaust manifolds 40, 42, 44, 46 and/or first and second EGR circuits 150, 160. Such data may be received from another controller or computer (not shown), from sensors strategically located throughout engine system 100, and/or from a user of engine 10. Controller 210 may then utilize stored algorithms, equations, subroutines, lookup maps and/or tables to analyze the operational condition data and determine a corresponding desired flow rate and/or constituency of exhaust within passageway 171 that sufficiently reduces generation of pollutants discharged to the atmosphere. Based on the desired flow rate and/or constituency, controller 210 may then cause first and second control valves 154, 164 to be adjusted such that the desired first and third amounts of exhaust may be supplied by first and second EGR circuits 150, 160 into first and second intake manifolds 26, 28. It is contemplated that the first amount of exhaust that may pass through first EGR circuit 150 may be greater than, less than, or about equal to the third amount of exhaust, which may pass through second EGR circuit 160.

Controller 210 may also adjust a first operating parameter for donor cylinders 16 to regulate an amount of a gaseous component which may be present in the exhaust generated by donor cylinders 16. In one exemplary embodiment, controller 210 may control a first operating parameter for first donor cylinder 16 such that a ratio of an amount of a gaseous component (e.g. nitrous oxide) and an amount of the particulate matter or soot in the first amount of exhaust is about equal to a predetermined value. In another exemplary embodiment, the ratio of the gaseous component and soot in the first amount of exhaust may be about equal to 3:1. In yet another exemplary embodiment, the predetermined value may be about equal to 3. Controller 210 may help ensure that passive regeneration of DPF 194 may take place. That is, controller 210 may help ensure that sufficient nitrous oxide is available to oxidize the soot trapped in DPF 194 by helping maintain the nitrous oxide to soot ratio be about equal to the predetermined value. Passive regeneration as used in this disclosure refers to the process by which soot trapped by DPF 194 may be oxidized in the presence of DOC 192 as exhaust including nitrous oxide flows through passageway 53. Further, passive regeneration in this disclosure refers to cleaning of DPF 194 without the need for injecting additional fuel into the exhaust to trigger oxidation of soot trapped by DPF 194. Passive regeneration of DPF 194 may help reduce or eliminate the need to remove DPF 194 for cleaning, thus reducing the time during which engine 10 is not available for use and consequently reducing the expense associated with performing such maintenance on DPF 194.

Controller 210 may similarly control a first operating parameter for second donor cylinder 16 to ensure that the nitrous oxide to soot ratio in the third amount of exhaust exiting the fourth exhaust manifold 46 exceeds the predetermine threshold. Further, controller 210 may control a second operating parameter for first and second non-donor cylinders 14 to ensure that the amount of harmful emissions such as nitrous oxide and soot produced by non-donor cylinders 14 is minimized. In one exemplary embodiment, the first operating parameter may be an injection timing, which may be measured as the time before or after TDC at which fuel is injected into the donor cylinders 16. In another exemplary embodiment, the first operating parameter may be an intake timing or the time at which intake ports 30 are unblocked and ready to allow air to enter combustion chamber 24. In yet another exemplary embodiment, the first operating parameter may be the first or third amount of exhaust. Second operating parameter may, similarly, be any of the parameters described above with regard to the first operating parameter.

Controller 210 may embody a single or multiple microprocessors, digital signal processors (DSPs), etc. that include means for controlling an operation of engine system 100 and engine 10. Numerous commercially available microprocessors can be configured to perform the functions of controller 210. It should be appreciated that controller 210 could readily embody a microprocessor separate from that controlling other machine-related functions, or that controller 210 could be integral with a machine microprocessor and be capable of controlling numerous machine functions and modes of operation. If separate from the general machine microprocessor, controller 210 may communicate with the general machine microprocessor via datalinks or other methods. Various other known circuits may be associated with controller 210, including power supply circuitry, signal-conditioning circuitry, actuator driver circuitry (i.e., circuitry powering solenoids, motors, or piezo actuators), and communication circuitry.

Figure 3:
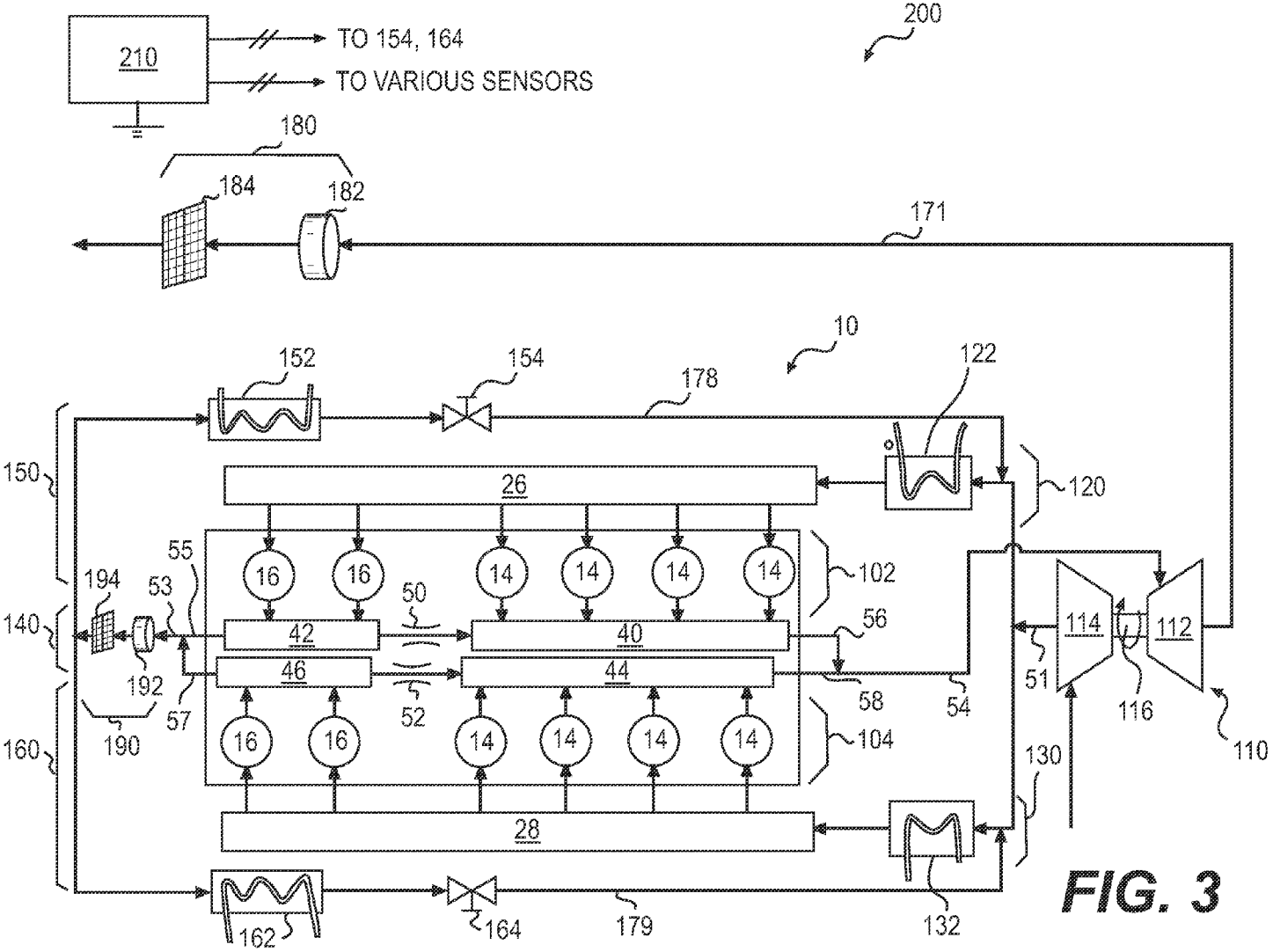
FIG. 3 is a diagrammatic illustration of another exemplary disclosed system that may be used in conjunction with the engine of FIG. 1.

FIG. 3 illustrates an engine system 200, which may be used in conjunction with engine 10. Many of the components of engine system 200 are similar to those already described with reference to engine system 100. In the following disclosure, only those components, which may be different from engine system 100, are described.

As shown in FIG. 3, first and third amounts of exhaust from second and fourth exhaust manifolds 42 and 46, respectively, may merge into passageway 53 which may direct exhaust to first and second EGR circuits 150 and 160. As further illustrated in FIG. 3, exhaust from passageways 55 and 57 may be treated using one or more after-treatment components 190, which may be disposed in passageway 53. It is also contemplated that one or more first and second after-treatment components 190 and 195 may be used to treat exhaust in passageways 55 and 57, respectively, before exhaust from passageways 55 and 57 flows into passageway 53.

Figure 4:
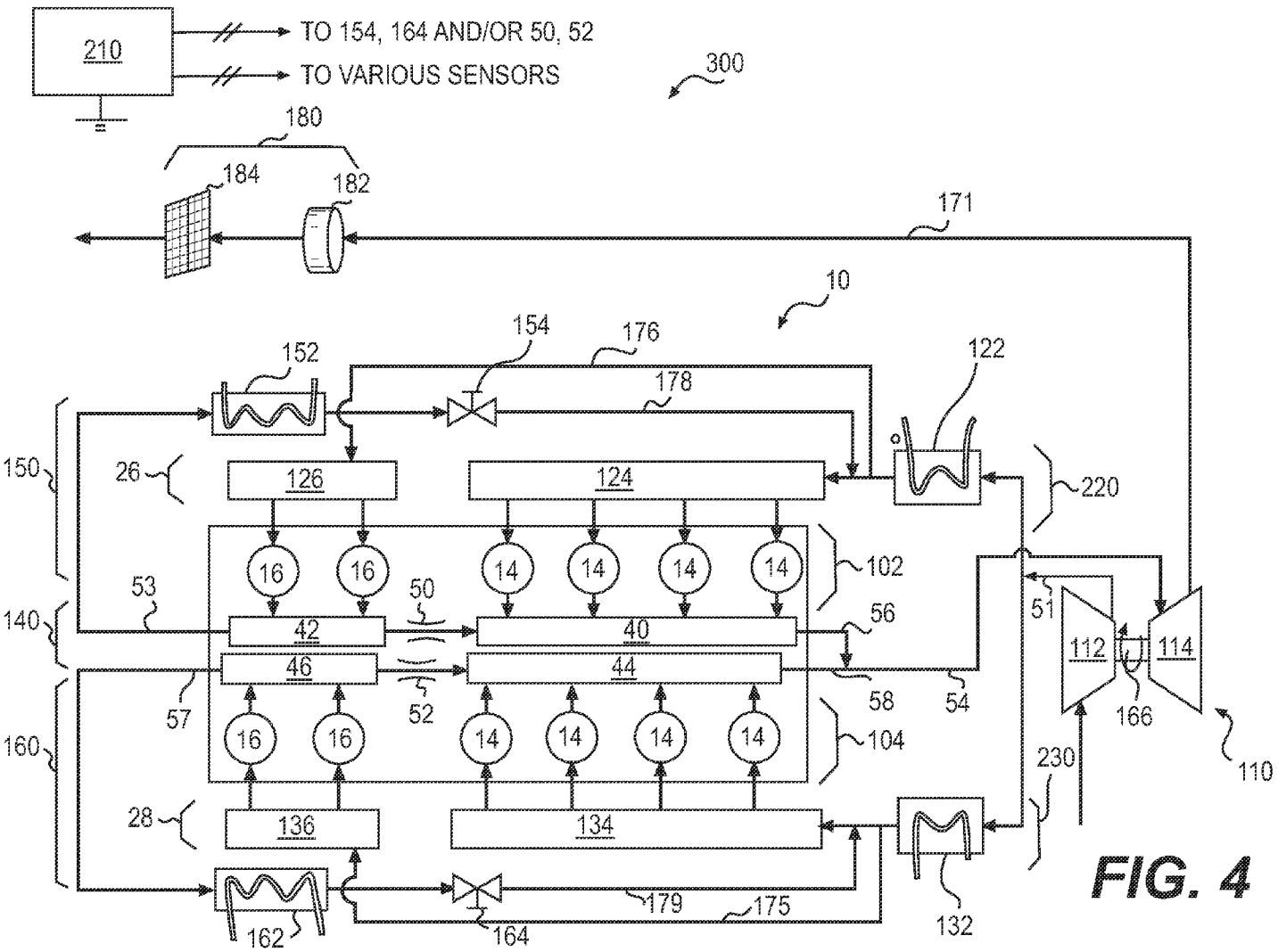
FIG. 4 is a diagrammatic illustration of another exemplary disclosed system that may be used in conjunction with the engine of FIG. 1.

FIG. 4 illustrates another exemplary engine system 300, which may be used in conjunction with engine 10. Many of the components of engine system 300 are similar to those already described with reference to engine system 100. In the following disclosure, only those components, which may be different from engine system 100, are described.

As shown in FIG. 4, first intake arrangement 220 may include a first aftercooler 122, a first section 124 and a second section 126. First section 124 may receive a mixture of a first portion of the cool air from first aftercooler 122 and the first amount of exhaust from first EGR circuit 150. First section 124 may direct the mixture of the first portion of the cool air and the first amount of exhaust to the one or more non-donor cylinders 14 in first cylinder bank 102. Second section 126 may receive a second portion of the cool air exiting first aftercooler 122 via passageway 176. Second section 126 may direct the second portion of the cool air to one or more donor cylinders 16 in first cylinder bank 102. One skilled in the art would understand that additional components such as orifices or control valves may be incorporated between first aftercooler 122 and first section 124 to ensure that exhaust from passageway 178 does not enter first aftercooler 122 or passageway 176. Thus, in engine system 300, unlike engine system 100, donor cylinders 16 in first cylinder bank 102 may receive only fresh air whereas non-donor cylinders 14 may receive a mixture of fresh air and exhaust recirculated by first EGR circuit 150.

Second cylinder bank 104 may function in a manner similar to that of first cylinder bank 102. Engine system 300 may include a second intake arrangement 230 which may include a second aftercooler 132, a third section 134 and a fourth section 136. Like first section 124, third section 134 may direct a mixture of fresh air and exhaust from second EGR circuit 160 to non-donor cylinders 14 in second cylinder bank 104. Similarly, like second section 126, fourth section 136 may direct only fresh air received via passageway 175 to donor cylinders 16 in second cylinder bank 104. One skilled in the art would understand that additional components such as orifices or control valves may be incorporated between second aftercooler 132 and third section 134 to ensure that exhaust from passageway 179 does not enter second aftercooler 132 or passageway 175.

As FIG. 4 also illustrates, in engine system 300, the first and third amounts of exhaust in first and second EGR circuits 150 and 160, respectively, may not pass through first and second aftercoolers 122 and 132, respectively. Instead, the first and third amounts of exhaust may mix with cooled air exiting from first and second aftercoolers 122 and 132, respectively. As a result, there may be no need to treat the exhaust flowing through first and second EGR circuits 150 and 160 in engine system 300 and first and second after-treatment components 190, 195 may be absent from engine system 300. It is contemplated, however, that engine system 300 may include first and second after-treatment components 190,195. Similarly, first and second after-treatment components 190, 195 may be included in or excluded from engine system 100. FIG. 4 depicts exhaust from second and fourth exhaust manifolds 42, 46 flowing separately through passageways 53, 57, respectively, into first and second EGR circuits 150 and 160, respectively. It is contemplated, however, that exhaust from second and fourth exhaust manifolds 42, 46 may merge and flow via a single passageway into first and second EGR circuits 150 and 160 as depicted in FIG. 2.

Figure 5:
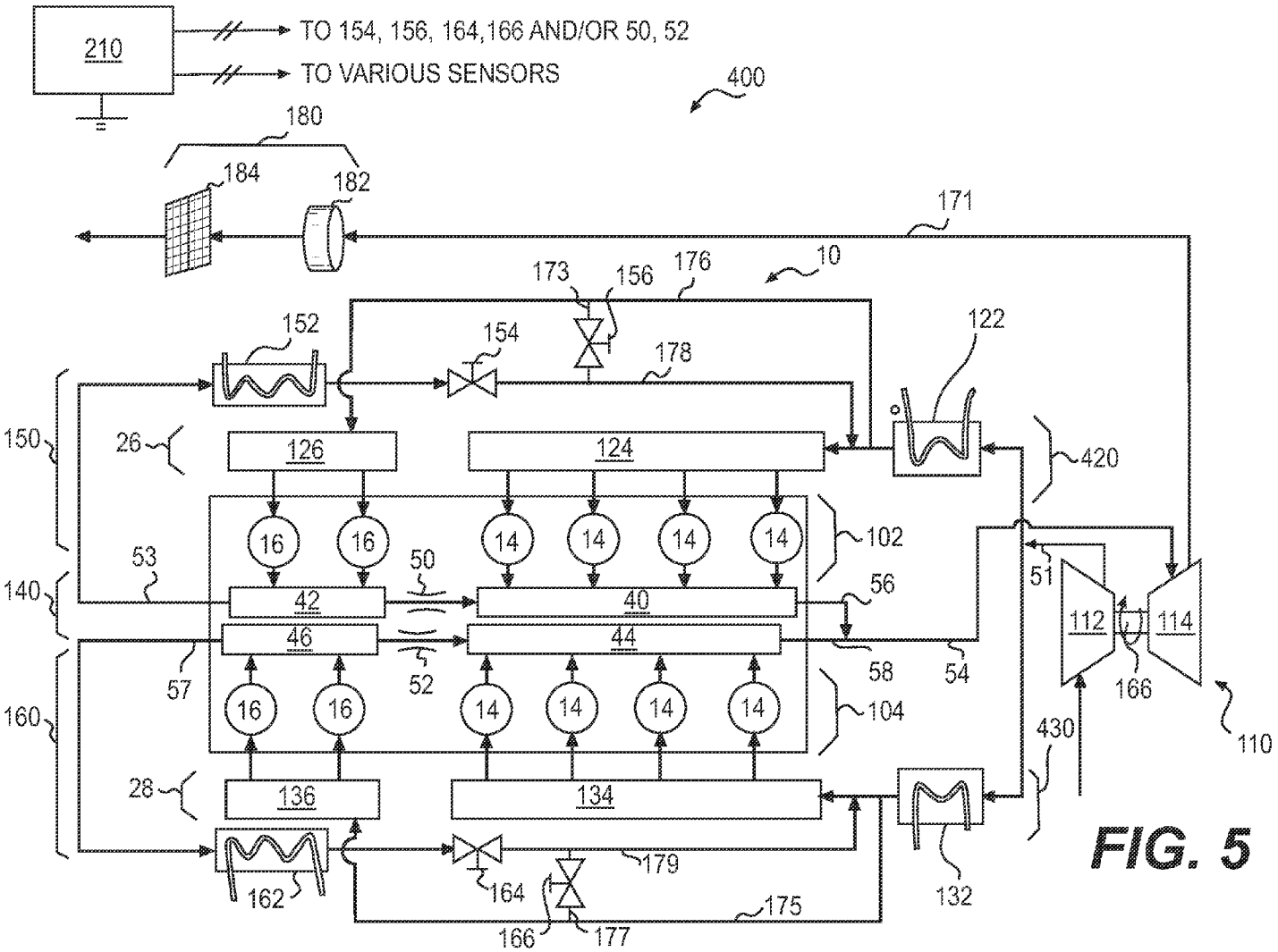
FIG. 5 is a diagrammatic illustration of another exemplary disclosed system that may be used in conjunction with the engine of FIG. 1.

FIG. 5 illustrates another exemplary engine system 400, which may be used in conjunction with engine 10. Many of the components of engine system 400 are similar to those already described with reference to engine systems 100 and 300. In the following disclosure, only those components, which may be different from engine systems 100 and 300, are described.

As shown in FIG. 5, first intake arrangement 420 may include third control valve 156 disposed in passageway 173. Passageway 173 may allow a donor cylinder portion of the first amount of exhaust to flow from passageway 178 to second section 126 through passageway 176. A first portion of the cool air from first aftercooler 122 may be directed to first section 124. A second portion of the cool air from first aftercooler 122 may pass flow through passageway 176. The donor cylinder portion of the first amount of exhaust may mix with the second portion of cool air in passageway 176 and enter second section 126, which may supply a first mixture having a first concentration of exhaust to donor cylinders 16. As used in this disclosure the first concentration of exhaust refers to the fraction of exhaust by weight or volume in the first mixture. A non-donor cylinder portion of the first amount of exhaust may flow through passageway 178 and mix with the first portion of cool air entering first section 124, which may direct a second mixture having a second concentration of exhaust to non-donor cylinders 14. As used in this disclosure the second concentration of exhaust refers to the fraction of exhaust by weight or volume in the second mixture. Thus, in engine system 400, unlike engine system 300, both donor cylinders 16 and non-donor cylinders 14 in first cylinder bank 102 may receive a mixture of fresh air and exhaust recirculated by first EGR circuit 150. It is contemplated that in engine system 400, the donor portion of the first amount of exhaust supplied to donor cylinders 16 may be the same or different from the non-donor cylinder portion of the first amount of exhaust supplied to non-donor cylinders 14 in first cylinder bank 102. Thus, the first concentration of exhaust and the second concentration of exhaust may be the same or different. FIG. 5 depicts one exemplary arrangement in which third control valve 156 directs the non-donor cylinder portion and the donor cylinder portion of the first amount of exhaust to first section 124 and second section 126, respectively. One skilled in the art would recognize that there may be other engine system configurations for directing a first concentration of exhaust and a second concentration of exhaust to donor cylinders 16 and non-donor cylinders 14, respectively, in first cylinder bank 102.

Second cylinder bank 104 may function in a manner similar to that of first cylinder bank 102. Engine system 400 may include a second intake arrangement 430, which may include fourth control valve 166 disposed in passageway 177. Passageway 177 may allow a donor cylinder portion of the third amount of exhaust to flow from passageway 179 to fourth section 136 through passageway 175. A third portion of the cool air from second aftercooler 132 may be directed to third section 134. A fourth portion of the cool air from second aftercooler 132 may flow through passageway 175. The donor cylinder portion of the third amount of exhaust may mix with the fourth portion of cool air in passageway 175 and enter fourth section 136, which may supply a third mixture having a third concentration of exhaust to donor cylinders 16. A non-donor cylinder portion of the third amount of exhaust may flow through passageway 179 and mix with the third portion of cool air and enter third section 134, which may direct a fourth mixture having a fourth concentration of exhaust to non-donor cylinders 14. As used in this disclosure, third and fourth concentrations of exhaust may be defined in a manner similar to that of the first and second concentrations. Thus, in engine system 400, unlike engine system 300, both donor cylinders 16 and non-donor cylinders 14 in second cylinder bank 104 may receive a mixture of fresh air and exhaust recirculated by second EGR circuit 160. Unlike engine system 300, in engine system 400, the donor cylinder portion of the third amount of exhaust supplied to donor cylinders 16 may be the same or different from the non-donor cylinder portion of the third amount of exhaust supplied to non-donor cylinders 14 in second cylinder bank 104. Thus, the third concentration of exhaust and the fourth concentration of exhaust may be the same or different. FIG. 5 depicts one exemplary arrangement in which fourth control valve 166 directs the non-donor cylinder portion and the donor cylinder portion of the third amount of exhaust to third section 134 and fourth section 136, respectively. One skilled in the art would recognize that there may be other engine system configurations for directing a third concentration of exhaust and a fourth concentration of exhaust to donor cylinders 16 and non-donor cylinders 14, respectively, in the second cylinder bank 104.

Controller 210 may control third and fourth control valves 156, 166 to control the amount of exhaust supplied to donor cylinders 16 from first and second EGR circuits 150, 160, respectively. Thus, by controlling third and fourth control valves 156, 166, controller 210 may regulate the first, second, third, and fourth concentrations of exhaust. It is contemplated that the first operating parameter for a donor cylinder 16 may be the donor cylinder portion of the first or third amount of exhaust. Similarly, it is contemplated that the second operating parameter for a non-donor cylinder 14 may be the non-donor cylinder portion of the first or third amount of exhaust.

FIG. 5 depicts exhaust from second and fourth exhaust manifolds 42, 46 flowing separately through passageways 53, 57, respectively, into first and second EGR circuits 150 and 160, respectively. It is contemplated, however, that exhaust from second and fourth exhaust manifolds 42, 46 may merge and flow via a single passageway into first and second EGR circuits 150 and 160 as depicted in FIG. 2. It is also contemplated that first and second intake arrangements 120 and 130 in engine system 100 (FIG. 2) may be replaced with first and second intake arrangements 220 and 230 (FIG. 4), respectively, or vice-versa. It is further contemplated that first and second intake arrangements 120 and 130 in engine system 100 (FIG. 2) may be replaced with first and second intake arrangements 420 and 430 (FIG. 5), respectively, or vice-versa.

INDUSTRIAL APPLICABILITY

The disclosed engine system may be used in any machine or power system application where it is beneficial to reduce emissions of harmful gases while delivering a maximum desired power output from an engine. The disclosed engine system may find particular applicability with mobile machines such as locomotives, which can be subjected to large variations in load. The disclosed engine system may provide an improved method for reducing harmful emissions in the exhaust discharged to the atmosphere while delivering adequate exhaust to the turbocharger to meet the power output demand from the engine at any load. An exemplary operation of engine system 100 will now be described.

During operation of engine system 100, air or a mixture of air and fuel may be pressurized by compressor 112, cooled by first and second aftercoolers 122, 132, and directed into non-donor cylinders 14 and donor cylinders 16 for subsequent combustion. Combustion of the air/fuel mixture may result in mechanical power being generated and directed from engine system 100 by way of a rotating crankshaft. By-products of combustion, namely exhaust and heat, may flow from engine system 100 through turbine 114 to the atmosphere.

A portion of the exhaust and heat produced by engine system 100 may also be selectively recirculated from second and fourth exhaust manifolds 42 and 46 into air intake arrangement 120 and 130, respectively. This exhaust may flow from second exhaust manifold 42 through first EGR cooler 152 and first control valve 154 into passageway 178. First EGR cooler 152 may cool the exhaust before the exhaust mixes with compressed air from compressor 112. The cooled and compressed mixture may be further cooled by first aftercooler 122 before entering non-donor cylinders 14 and donor cylinders 16, along with fuel, for subsequent combustion. The recirculation of exhaust may help dilute the mixture of fuel and air and increase the thermal capacity within non-donor cylinders 14 and donor cylinders 16, resulting in a lower combustion temperature, which in turn may reduce a rate of nitrous oxide formed during combustion. Cooling the mixture of fresh air and the first amount of exhaust via first aftercooler 122 may also help to reduce the rate of nitrous oxide formation during combustion.

During the power/intake/exhaust stroke, first intake manifold may direct an intake charge into non-donor cylinder 14. The intake charge may include fresh air or a mixture of air and recirculated exhaust gas. Controller 210 may adjust a position of first control valve 154 to direct a first amount of exhaust from second exhaust manifold 42 through first EGR circuit 150 to first intake manifold 26. At the same time first orifice 50 may permit a second amount of exhaust to pass from second exhaust manifold 42 to first exhaust manifold 40. Controller 210 may also communicate with sensors that measure an amount of nitrous oxide or soot in exhaust flowing in passageway 171.

Controller 210 may adjust the position of first control valve 154 to increase the first amount of exhaust flowing from second exhaust manifold 42 to first intake manifold 26 to help ensure that the amount of nitrous oxide or soot in passageway 171 remains below the permitted limits. When controller 210 adjusts first control valve 154 to a partially open position, a pressure within second exhaust manifold 42 may increase. First orifice 50 may permit a second amount of exhaust to flow from second exhaust manifold 42 to first exhaust manifold 40 based on the pressure within second exhaust manifold 42. Controller may similarly adjust a position of second control valve 164 to control a third amount of exhaust flowing from fourth exhaust manifold 46 to second intake manifold 28. For example, when controller 210 adjusts second control valve 164 to a partially open position, a pressure within fourth exhaust manifold 46 may increase. Second orifice 52 may permit a second amount of exhaust to flow from fourth exhaust manifold 46 to third exhaust manifold 44 based on the pressure within fourth exhaust manifold 46. Thus controller 210 may control first and second control valves 154 and 164 to help ensure that a sufficient amount of exhaust may be recirculated from the second and fourth exhaust manifolds 42, 46 to the first and second intake manifolds 26, 28, respectively to help reduce the generation of harmful emissions. One skilled in the art would recognize that the first amount of exhaust and the third amount of exhaust may be equal or unequal. In addition, controller 210 may allow a sufficient amount of exhaust to pass through first and second orifices 50, 52 to help ensure that a desired amount of exhaust may be supplied to propel turbocharger 110. In certain exemplary embodiments, when orifices 50 and 52 comprise variable area devices, controller 210 may adjust the cross-sectional area within orifice 50 to further control the second amount of exhaust that may pass from second exhaust manifold 42 to first exhaust manifold 40 through orifice 50. Controller 210 may similarly adjust the cross-sectional area within orifice 52 to control the fourth amount of exhaust that may pass from fourth exhaust manifold 46 to third exhaust manifold 44 through orifice 52.

Controller 210 may also communicate with sensors that measure an amount of nitrous oxide or other exhaust gases, and soot in the first amount of exhaust flowing out of second exhaust manifold 42 and in the third amount of exhaust flowing out of fourth exhaust manifold 46. Controller may adjust a first operating parameter related to first donor cylinder 16 or a second operating parameter related to first non-donor cylinder 14 when a ratio of an amount of an exhaust gas component and an amount of soot is different from a predetermined value. In one exemplary embodiment, controller 210 may adjust the first operating parameter and/or the second operating parameter when the nitrous oxide to soot ratio in the first amount of exhaust is different from the predetermined value. By allowing a higher concentration of nitrous oxide in the first amount of exhaust, controller 210 may help ensure that a sufficient amount of nitrous oxide may be available to DOC 192 to help promote oxidation of soot in DPF 194. By self-regenerating DPF 194 in this manner, controller 210 may allow engine system 100 to perform continuous operations without the need to shut down engine 10 for removal and cleaning of DPF 194.

Controller 210 may determine the first operating parameter from a first lookup table including a first set of data values that relate the first operating parameter to a load on engine 10. Additionally or alternatively, the first set of data values may relate the first operating parameter to a speed of engine 10, which may be represented by, for example, a rate of rotation of the crankshaft in engine 10 or by a rate of travel of a machine (not shown) that includes engine 10. Controller 210 may determine the second operating parameter in a manner similar to that for the first operating parameter from a second lookup table including a second set of data values that relate the second operating parameter to a load on engine 10 or a speed of engine 10 or both. It is also contemplated that controller 210 may determine both the first operating parameter and the second operating parameter from the first lookup table or from the second lookup table. It is further contemplated that controller 210 may determine both the first operating parameter and the second operating parameter from a combination of the first lookup table and the second lookup table.

Engine system 200 may operate in a similar manner to that of engine system 100. During an exemplary operation of engine system 200, controller 210 may regulate first control valve 154 to help deliver a first amount of exhaust from donor cylinders 16 to non-donor cylinders 14. In system 200, because passageways 55 and 57 merge into passageway 53, the first amount of exhaust flowing through first EGR circuit 150 may come from one or both of second exhaust manifold 42 and fourth exhaust manifold 46. Controller 210 may similarly regulate second control valve 164 to help deliver a third amount of exhaust from donor cylinders 16 to non-donor cylinders 14. The third amount of exhaust flowing through second EGR circuit 160 may come from one or both of second exhaust manifold 42 and fourth exhaust manifold 46.

Engine system 300 may operate in a similar manner to that of engine system 100. During an exemplary operation of engine system 300, controller 210 may regulate first control valve 154 to help deliver a first amount of exhaust from donor cylinders 16 to non-donor cylinders 14. Controller 210 may similarly regulate second control valve 164. Because exhaust may be recirculated only through non-donor cylinders 14 in engine system 300, the first and third amounts of exhaust in engine system 300 may be smaller than the first and third amounts of exhaust in engine system 100 (See FIG. 2). By reducing the amount of exhaust recirculated from donor cylinders 16 in engine system 300, more exhaust may be available to propel turbocharger 110 thereby increasing turbocharger energy.

Engine system 400 may operate in a similar manner to that of engine system 300. During operation of engine system 400, controller 210 may regulate third control valve 156 to help deliver a donor cylinder portion of the first amount of exhaust to donor cylinders 16. A non-donor cylinder portion of the first amount of exhaust may be delivered to non-donor cylinders 14. Controller 210 may similarly regulate second control valve 164.

It will be apparent to those skilled in the art that various modifications and variations can be made to the disclosed engine system without departing from the scope of the disclosure. Other embodiments of the engine system will be apparent to those skilled in the art from consideration of the specification and practice of the engine system disclosed herein. It is intended that the specification and examples be considered as exemplary only, with a true scope of the disclosure being indicated by the following claims and their equivalents.

What is claimed is:

1. An engine system, comprising:

a first intake manifold configured to direct air into a first donor cylinder and a first non-donor cylinder of an engine;

a second intake manifold configured to direct the air into a second donor cylinder and a second non-donor cylinder of the engine;

a first exhaust manifold configured to direct exhaust from the first non-donor cylinder to the atmosphere;

a second exhaust manifold configured to receive exhaust from the first donor cylinder;

a third exhaust manifold configured to direct exhaust from the second non-donor cylinder to the atmosphere;

a fourth exhaust manifold configured to receive exhaust from the second donor cylinder;

a first control valve configured to selectively direct a first amount of exhaust from the second exhaust manifold to the first intake manifold;

a second control valve configured to selectively direct a third amount of exhaust from the fourth exhaust manifold to the second intake manifold; and an orifice configured to allow a second amount of exhaust to flow from the second exhaust manifold to the first exhaust manifold.

2. The engine system of claim 1, further including a cooler configured to cool the air and direct the cool air to the first intake manifold.

3. The engine system of claim 2, wherein the cooler is further configured to:

cool the first amount of exhaust, and direct a mixture of the cool air and the first amount of exhaust to the first intake manifold.

4. The engine system of claim 3, wherein:

the first control valve is configured to selectively direct the first amount of exhaust from the second and fourth exhaust manifolds to the first intake manifold; and the second control valve is configured to selectively direct the third amount of exhaust from the second and fourth exhaust manifolds to the second intake manifold.

5. The engine system of claim 3, wherein the orifice is a first orifice, and the engine system further includes a second orifice configured to allow a fourth amount of exhaust to flow from the fourth exhaust manifold to the third exhaust manifold.

6. The engine system of claim 5, wherein:

the first orifice has a first variable area;

the second orifice has a second variable area; and the engine system further includes a controller configured to selectively adjust the first and second variable areas to control the second and fourth amounts of exhaust.

7. The engine system of claim 6, wherein the controller is in communication with the first and second control valves and is configured to selectively adjust the first amount of exhaust and the third amount of exhaust.

8. The engine system of claim 7, wherein the first amount of exhaust and the third amount of exhaust are equal.

9. The engine system of claim 8, further including:

a diesel particulate filter configured to filter the first and third amounts of exhaust; and a diesel oxidation catalyst disposed upstream of the diesel particulate filter.

10. The engine system of claim 9, wherein the diesel particulate filter is a first diesel particulate filter, the diesel oxidation catalyst is a first diesel oxidation catalyst, and the engine system further includes:

a second diesel particulate filter configured to filter the second and fourth amounts of exhaust before being discharged to the atmosphere; and a second diesel oxidation catalyst disposed upstream of the second diesel particulate filter.

11. A method of operating an engine, comprising:

directing air through a first intake manifold into a first donor cylinder and a first non-donor cylinder of the engine;

directing exhaust from the first non-donor cylinder through a first exhaust manifold to the atmosphere;

directing exhaust from the first donor cylinder to a second exhaust manifold;

selectively directing a first amount of exhaust from the second exhaust manifold to the first intake manifold;

directing a second amount of exhaust from the second exhaust manifold through an orifice to the first exhaust manifold;

directing the air into a second donor cylinder and a second non-donor cylinder of the engine through a second intake manifold;

directing exhaust from the second non-donor cylinder through a third exhaust manifold to the atmosphere;

directing exhaust from the second donor cylinder to a fourth exhaust manifold;

selectively directing a third amount of exhaust from the fourth exhaust manifold to the second intake manifold; and directing a fourth amount of exhaust from the fourth exhaust manifold to the third exhaust manifold.

12. The method of claim 11, further including:

cooling air using a cooler; and directing the cooled air to the first intake manifold.

13. The method of claim 12, wherein the first amount of exhaust is equal to the third amount of exhaust.

14. The method of claim 11, further including:

determining an amount of an exhaust gas component in the exhaust from the first non-donor cylinder; and increasing the first amount of exhaust when the amount of the exhaust gas component is different from a predetermined value.

15. The method of claim 14, further including filtering the first amount of exhaust before directing the first amount of exhaust to the first intake manifold.

16. The method of claim 15, further including filtering the second amount of exhaust before discharging the second amount of exhaust into the atmosphere.

17. An engine, comprising:

a first cylinder bank including a first donor cylinder and a first non-donor cylinder;

a second cylinder bank including a second donor cylinder and a second non-donor cylinder;

a first intake manifold connected between the atmosphere and the first cylinder bank;

a second intake manifold connected between the atmosphere and the second cylinder bank;

a first exhaust manifold fluidly connected to the first non-donor cylinder;

a second exhaust manifold fluidly connected to the first donor cylinder;

a third exhaust manifold fluidly connected to the second non-donor cylinder;

a fourth exhaust manifold fluidly connected to the second donor cylinder;

a first control valve associated with the second exhaust manifold and selectively movable to allow a first amount of exhaust to pass from the second exhaust manifold into the first intake manifold;

a first orifice to allow a second amount of exhaust to flow between the second exhaust manifold and the first exhaust manifold;

a second control valve associated with the second exhaust manifold and selectively movable to allow a third amount of exhaust to pass from the fourth exhaust manifold into the second intake manifold;

a second orifice to allow a fourth amount of exhaust to flow between the forth exhaust manifold and the third exhaust manifold; and a controller configured to selectively control the first and second control valves.

18. The engine of claim 17, wherein the first intake manifold includes:

a first section configured to direct air to the first donor cylinder; and a second section configured to direct the air to the first non-donor cylinder.

19. The engine of claim 17, wherein the first intake manifold includes:

a first section configured to direct a first concentration of exhaust into the first donor cylinder; and a second section configured to direct a second concentration of exhaust into the first non-donor cylinder.

20. The engine of claim 19, further including:

a cooler configured to cool the air and direct the first portion of the cool air to the first section and the second portion of the cool air to the second section;

a third control valve configured to direct the donor cylinder portion of the first amount of exhaust to the first section and the non-donor cylinder portion of the first amount of exhaust to the second section.

* * * * *